US007710413B2

(12) United States Patent
Yamamoto

(10) Patent No.: US 7,710,413 B2
(45) Date of Patent: May 4, 2010

(54) VOLTAGE REGULATOR

(75) Inventor: Ryuji Yamamoto, Yao (JP)

(73) Assignee: Sanyo Electric Co., Ltd., Osaka (JP)

( * ) Notice: Subject to any disclaimer, the term of this patent is extended or adjusted under 35 U.S.C. 154(b) by 360 days.

(21) Appl. No.: 11/823,038

(22) Filed: Jun. 26, 2007

(65) Prior Publication Data

US 2008/0042635 A1 Feb. 21, 2008

(30) Foreign Application Priority Data

Jun. 28, 2006 (JP) ..... 2006-178342

(51) Int. Cl.
*G06F 3/038* (2006.01)
*G05F 3/16* (2006.01)

(52) U.S. Cl. ..... 345/211; 323/314; 345/94

(58) Field of Classification Search ..... 345/211, 345/204, 94, 100; 323/314, 304, 351
See application file for complete search history.

(56) References Cited

U.S. PATENT DOCUMENTS 5,627,457 A * 5/1997 Ishiyama et al. ..... 323/318
6,121,945 A * 9/2000 Tanaka et al. ..... 345/94
6,281,871 B1 8/2001 Nohara

FOREIGN PATENT DOCUMENTS

JP 61-249094 11/1986
JP 3423193 4/2003

OTHER PUBLICATIONS

Partial Translation from Japanese Patent Laid-Open Publication No. 61-249094, Publication date Nov. 6, 1986 (1 page).
esp@cenet patent abstract for Japanese Publication No. 11024633, Publication date Jan. 29, 1999 (1 page).

* cited by examiner

*Primary Examiner*—Jimmy H Nguyen
(74) *Attorney, Agent, or Firm*—Osha • Liang LLP

(57) ABSTRACT

A voltage regulator 10 includes: a level shifting circuit unit 14 shifting a first voltage, which is a voltage level of a first power source 12, to a target value of a second voltage to output the shifted first voltage; a voltage-to-current converting circuit unit 20 varying a magnitude of an output current to output the current while changing a direction of a current using a variable power source 22 varying a voltage to larger and smaller values than a center voltage of an arbitrarily variable voltage range; and an adder-subtracter circuit unit 32 having a first terminal on one side, the first terminal being connected to an output terminal of the level shifting circuit unit, and a second terminal on the other side, the terminal being connected to a resistance element disposed between the second terminal and an output terminal, the resistance element allowing an output current of the voltage-to-current converting circuit unit to flow therethrough as a bias current, wherein a second voltage $V_2$ is output from an output terminal 42.

3 Claims, 6 Drawing Sheets

| MODELS | CUSTOMERS | $V_1$ | $V_2$ | VOLTAGE-TO-CURRENT CONVERSION | LEVEL SHIFTING |
|---|---|---|---|---|---|
| X | A | 4.0 V | 3.0 V | CENTER VOLTAGE | 4.0V →3.0V |
| | B | 4.0 V | 2.7 V | −0.3V | |
| | C | 4.0 V | 3.2 V | +0.2V | |
| Y | D | 7.0 V | 3.0 V | CENTER VOLTAGE | 7.0V →3.0V |

Fig. 9

VOLTAGE REGULATOR

CROSS-REFERENCE TO RELATED APPLICATIONS

This application claims priority to Japanese Patent Application No. 2006-178342, filed on Jun. 28, 2006, which is incorporated herein by reference in its entirety.

BACKGROUND OF THE INVENTION

1. Field of the Invention

The present invention relates to a voltage regulator, and more particularly to a voltage regulator generating a second voltage having a desired potential difference from a first voltage.

2. Description of the Related Art

If a plurality of voltage systems are used in one apparatus, their voltage levels are sometimes adjusted so as to be in a relation of mutually having predetermined potential differences. For example, AC driving is performed in a liquid crystal panel in order to suppress the occurrence of deterioration and burnout of a liquid crystal, and the polarities of a video signal and a common electrode signal, which is the counter electrode signal of the video signal, are inverted every frame. In this case, the DC bias voltages of the video signal and the common electrode signal are set to have a predetermined potential difference from each other.

For example, Japanese Patent No. 3423193 and U.S. Pat. No. 6,281,871 B1 point out that, in the case of displaying a fully colored image by a video signal, respective R, G, and B signals are provided to a liquid crystal panel after they are converted into alternating current signals. The publications describes that, if the center potential of the respective R, G, and B alternating current signals differs from that of the opposed electrode, then problems occur, such as burnout, difference in white balance, or degradation of contrast. Moreover, the publications describe that, in order to make the center voltage uniform among the R, G, and B signals, the AC signal applied to the liquid crystal panel is converted to a DC voltage by a smoothing circuit, and is compared with a reference voltage, which is the center point of the AC signal, in a comparator, and that the comparator output is fed back to a bias current of a differential output amplifier so that the center potential of the AC signal is made to conform to the reference voltage.

Japanese Patent Laid-Open Publication No. Sho 61-249094 describes that a video signal having a polarity inverted every field is applied to the Y electrode of one pixel of a matrix type liquid crystal display apparatus, and that a common electrode signal having a voltage value inverted every field is applied to a common electrode, and further that the relation between the video signal and the common voltage becomes incorrect owing to the dispersion of interelectrode capacitance and storage capacitors. The patent publication discloses that a video signal whose polarity is inverted by a polarity inverting circuit is taken out from the emitter follower of a transistor, and that the emitter follower is connected to a current source composed of a transistor and a variable resistor with a resistor connected between them to change the current of the current source with the variable resistor in order to change the voltage level of the resistor so that the DC level of the video signal having the inverted polarity may be changed.

As described in the examples above, in a liquid crystal display apparatus, the DC potential difference between a video signal and a common electrode signal is determined in accordance with the specification of the liquid crystal display apparatus, and the DC potential difference is adjusted in conformity with the specification. For the voltage adjustment, the following methods can be used: a method of performing feedback to the bias current of the differential output amplifier based on the comparison of the reference voltage and the center voltage of an AC signal, which method is described in the U.S. Pat. No. 6,281,871 B1, a method of changing a current to change the voltage level between both ends of a resistor, which method is described in the Japanese Patent Laid-Open Publication No. Sho 61-249094, and the like.

However, these related art technologies collectively adjust the contents of two steps at one time. Moreover, because the related art adjusts the contents by shifting them from the reference state, an error of the adjustment becomes larger as the adjustment range from the reference becomes larger. For example, in the case of the method disclosed in the U.S. Pat. No. 6,281,871 B1, when a desired potential difference is large, the center voltage of the AC signal, i.e. the value of a DC level, becomes larger, and consequently the value of the reference voltage becomes larger to increase a setting error by that much. In the case of the method disclosed in the Japanese Patent Laid-Open Publication No. Sho 61-249094, the voltage level between both ends of the resistor is set to become larger as the desired potential difference becomes larger, and consequently the setting error becomes larger by that much.

As described above, with the methods of the related art, errors become larger as the extent of voltage adjustment becomes larger, and it is sometimes difficult to obtain a correct potential difference.

SUMMARY OF THE INVENTION

An advantage of the present invention is to make it possible to set a desired potential difference more correctly in a voltage regulator generating a second voltage having a desired potential difference from a first voltage.

A voltage regulator according to the present invention is one generating a second voltage having a desired potential difference from a first voltage, the voltage regulator comprising: a level shifting circuit unit shifting a voltage level of the first voltage to a target value of the second voltage to output the shifted first voltage; a voltage-to-current converting circuit unit, which is a voltage-to-current converting circuit, varying a magnitude of an output current to output the current while changing a direction of the current by varying a voltage to larger and smaller values with respect to a center voltage of an arbitrarily variable voltage range; and an adder-subtracter circuit unit having a first terminal on one side, the first terminal being connected to an output terminal of the level shifting circuit unit, and a second terminal on the other side, the second terminal being connected to a resistance element disposed between the second terminal and an output terminal, the resistance element allowing an output current of the voltage-to-current converting circuit unit to flow therethrough as a bias current, wherein a bias voltage generated by the bias current and the resistance element is used as an adjustment voltage and a voltage generated by addition and subtraction of the adjustment voltage to and from a voltage output from the level shifting circuit unit is output from the adder-subtracter circuit unit as the second voltage.

BRIEF DESCRIPTION OF THE DRAWINGS

FIG. 9 is a diagram for illustrating a configuration example of the voltage regulator of the embodiment according to the present invention, the configuration being capable of dealing with the demands of various customers.

DESCRIPTION OF PREFERRED EMBODIMENTS

In the following, an embodiment according to the present invention will be described in detail with reference to the attached drawings. In the following, a description will be given of the setting between the DC level of a video signal of a liquid crystal display apparatus and the DC level of a common electrode signal as an application object of a voltage adjustment apparatus, but the setting is an example of the application. In addition to the setting, as long as a voltage regulator is one generating a second voltage having a desired potential difference with respect to a first voltage, the voltage regulator may be one used for the voltage adjustment of the other element of the liquid crystal display apparatus, and may be one used for the voltage adjustment of electronic equipment other than the liquid crystal display apparatus. Moreover, voltage values, resistance values, current values, and the like in the following description are only examples, and can be suitably changed according to requirements.

Figure 1:
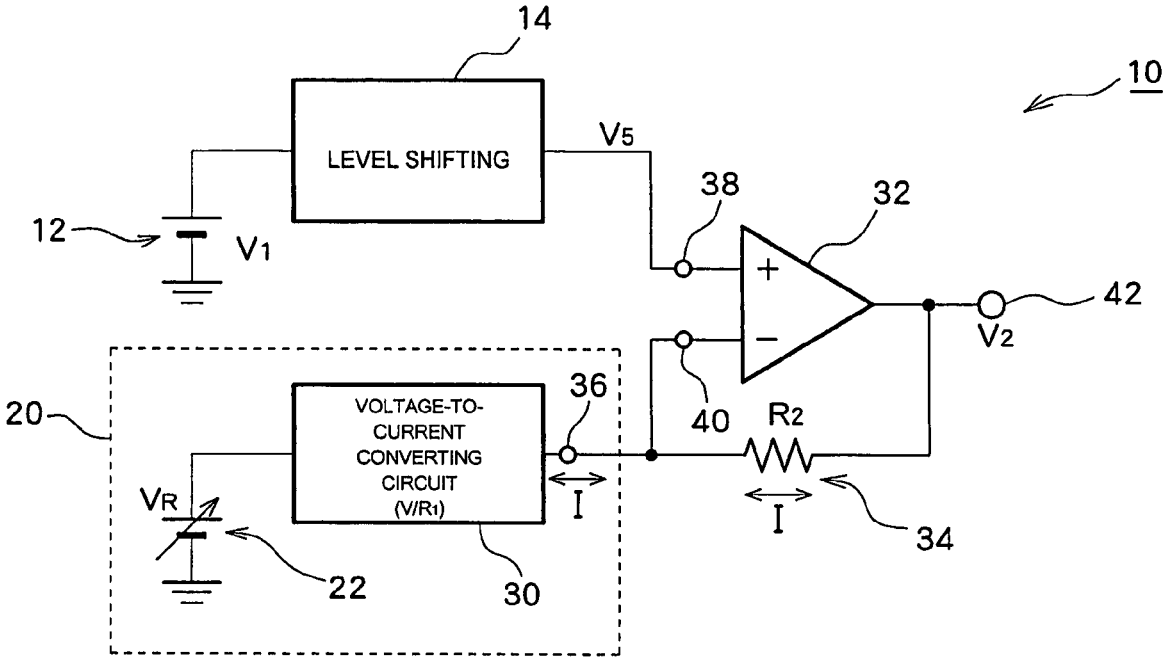
FIG. 1 is a configuration diagram of a voltage regulator of an embodiment according to the present invention.
Figure 2:
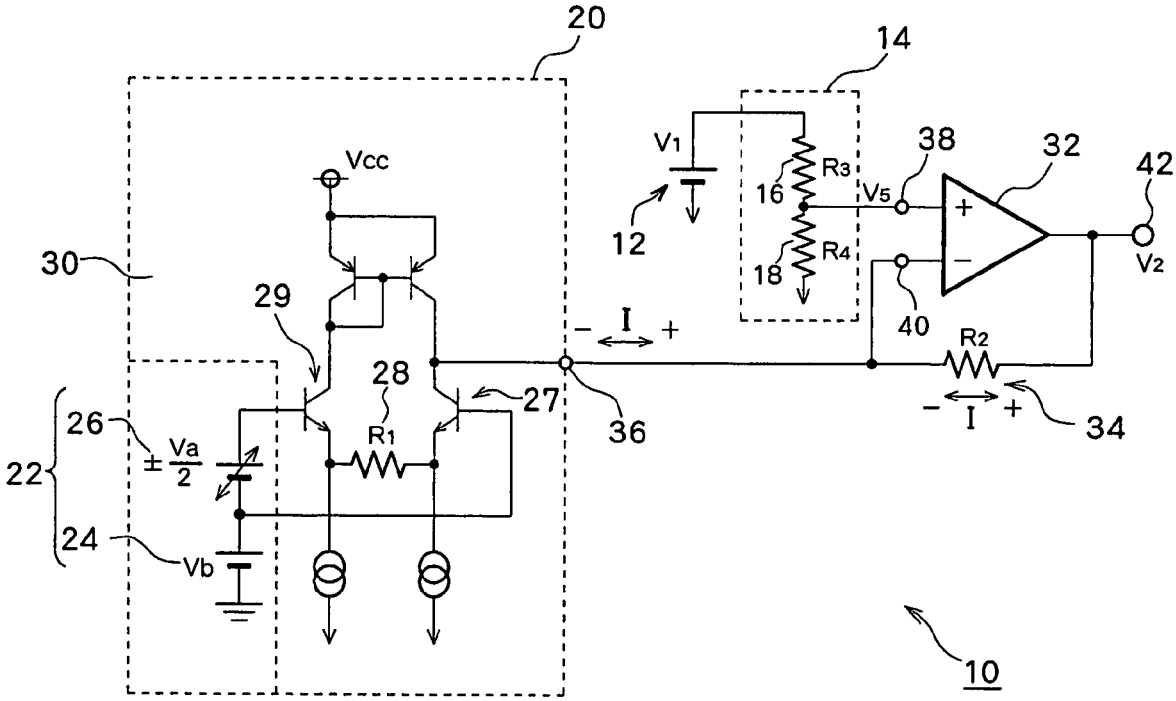
FIG. 2 is a detailed configuration diagram of the voltage regulator of the embodiment according to the present invention.

FIG. 1 is a configuration diagram of a voltage regulator 10, and FIG. 2 is a detailed diagram thereof. The voltage regulator 10 is used for a not shown liquid crystal display apparatus, and is a circuit having the function of adjusting and setting a relation between the DC level of a video signal, i.e. a video signal DC bias voltage, and the DC level of a common electrode signal, i.e. a common electrode signal DC bias voltage, so as to be a predetermined potential difference determined by the specification of the liquid crystal display apparatus. In FIG. 1, a first power source 12 is shown as the power source of a first voltage $V_1$, which is the video signal DC bias voltage. In this configuration, a level shifting circuit unit 14, a voltage-to-current converting circuit unit 20 including a variable power source 22, and an adder-subtracter circuit unit 32 including an arranged resistance element 34 as a bias resistance are used to output a second voltage $V_2$, which is the common electrode signal DC bias voltage, to an output terminal 42.

The level shifting circuit unit 14 is a circuit having the function of dropping a voltage from the first voltage $V_1$ to a target value $V_5$ of the second voltage. The potential difference between the first voltage $V_1$ and the target value $V_5$ is, for example, the so-called standard potential difference between the DC voltage level of a video signal and the DC voltage level of a common electrode signal. The liquid crystal display apparatus is ordinarily set to be driven by the standard potential difference, but the potential difference is sometimes set to be a little different from the standard potential difference according to the demands of a customer. In this case, the setting is performed by adjusting the potential difference to a desired potential difference rather than the adjustment to the standard potential difference by the function of the voltage-to-current converting circuit unit 20 including the variable power source 22.

The level shifting circuit unit 14 outputs a target value given by the formula $V_5=V_1\{R_3/(R_3+R_4)\}$ by a resistance dividing method using two series resistors 16 and 18 as shown in FIG. 2. For example, if the first voltage $V_1$ is supposed to be 4.0 V and the target value $V_5$ of the second voltage is 3V, then the resistance ratio of the resistors 16 and 18 may be determined so that the value of the formula $\{R_3/(R_3+R_4)\}$ becomes 3/4.

Because the level shifting circuit unit 14 using the resistance dividing method can drop the voltage to the target value $V_5$ of the second voltage by the resistance ratio, the voltage can be dropped from the first voltage $V_1$ to the target value $V_5$ of the second voltage more correctly by raising the accuracy of the resistance ratio in comparison with the level shifting circuits of the other configurations, for example, the method of shifting the voltage level by adjusting the flow rate of a current using a differential output amplifier or the like.

The voltage-to-current converting circuit unit 20 including the variable power source 22 is a circuit having the function of varying the magnitude of an output current while changing the direction of a current by varying a voltage to larger and smaller values than the center voltage of an arbitrary variable voltage range, and outputting the output current. The voltage-to-current converting circuit unit 20 including the variable power source 22 is composed of the variable power source 22 and a V-I converting circuit 30 converting a voltage to a current using a built-in resistance R1. More specifically, to the base bias voltage of a differential transistor 27 on one side between a pair of differential transistors 27 and 29 constituting a differential output amplifier, the base bias voltage of the differential transistor 29 on the other side is adjusted to both the plus and minus sides as shown in FIG. 2, and then a current I determined by the difference voltage between both the base bias voltages and the resistance R1 provided between the pair of differential transistors 27 and 29 is output.

The configuration of FIG. 2 is further described in detail. The variable power source 22 is composed of a fixed power source 24 of a fixed voltage Vb and a both side variable power source 26 of a variable range Va capable of being varied to both sides of the center voltage by ±(Va/2). The base bias of the differential transistor 27 on one side between the pair of differential transistors 27 and 29 in the V-I converting circuit 30 is supplied by the fixed power source 24, and the voltage of the base bias is $V_b$, which is a fixed value. The base bias of the differential transistor 29 on the other side is supplied by the fixed power source 24 and the both side variable power source 26, and the voltage of the base bias is {Vb±(Va/2)}. Each emitter of the pair of differential transistors 27 and 29 is connected to a constant current source, and a resistance element 28 is connected between both the emitters. The resistance value of the resistance element 28 is denoted by $R_1$. Because the base biases of the pair of differential transistors 27 and 29 are different from each other and the emitters of the pair of the differential transistors 27 and 29 are connected to the constant current sources, a current substantially equal to the value obtained by dividing the difference voltage ±(Va/2) between both the base biases by the resistance R1 of the resistance element 28, $\pm(Va/2)/R_1$, appears at an output terminal 36 provided to the terminal on the collector side of the differential transistor 27 on the one side.

The current appearing at the output terminal 36 of the voltage-to-current converting circuit unit 20 including the variable power source 22 is denoted by I, and the sign of the current is determined so that the direction in which the current flows out from the output terminal 36 is denoted by plus, and that the direction in which the current is drawn into the output terminal 36 is denoted by minus. If the difference voltage between the base biases is made to be zero, the current I is zero. If the difference voltage between the base biases is made to be +(Va/2), the current I becomes about $+(Va/2)/R_1$. If the difference voltage between the base biases is adversely made to be −(Va/2), the current I becomes about $-(Va/2)/R_1$.

In this way, if the variable voltage is set to the center voltage Vb in the variable range of the base bias of the differential transistor 29, or in the range from the voltage {Vb−(Va/2)} to the voltage {Vb+(Va/2)}, then the current I becomes zero at the output terminal 36. If the variable voltage is set to a voltage higher than the center voltage Vb, then a flowing out current +I appears at the output terminal 36. If the variable voltage is set to a voltage lower than the center voltage Vb, then a drawn in current −I appears at the output terminal 36. That is, when the voltage is varied to the lower voltage side relative to the center voltage Vb, the direction of the current I can be made to be opposite to that when the voltage is varied to the higher voltage side relative to the center voltage Vb.

The adder-subtracter circuit unit 32 including the resistance element 34 as a bias resistance is configured so that a terminal 38 on one side of the adder-subtracter circuit unit 32 is connected to the output terminal of the level shifting circuit unit 14, and the resistance element 34, through which the output current I of the voltage-to-current converting circuit unit 20 flows as a bias current I, is disposed between a terminal 40 on the other side and the output terminal 42 of the adder-subtracter circuit unit 32. If the resistance value of the resistance element 34 is denoted by $R_2$, then the bias voltage generated by the bias current I and the resistance element 34 is expressed by $IR_2$. If the bias voltage is expressed as an adjustment voltage $IR_2$, the adjustment voltage $IR_2$ is added to or subtracted from the voltage $V_5$ output from the level shifting circuit unit 14 to be the second voltage $V_2$. The adder-subtracter circuit unit 32 is an addition and subtraction circuit having the function of outputting the thus operated second voltage $V_2$ from the output terminal 42.

In the adder-subtracter circuit unit 32 including the resistance element 34 disposed as the bias resistance in the configuration as shown in FIG. 2, the voltage $V_2$ output from the output terminal 42 is $V_5-IR_2$. Incidentally, the sign of the current I is set to be plus in the direction of flowing from the terminal 40 on the other side to the output terminal 42. The setting method of the sign is the same one as that of the direction of the current I appearing at the output terminal 36 of the voltage-to-current converting circuit unit 20 when the base bias of the circuit unit 20 is varied.

Consequently, when the base bias of the differential transistor 29 in the voltage-to-current converting circuit unit 20 is set to the center voltage Vb, the current I is 0. Hence, the voltage $V_2$ equal to the voltage $V_5$, i.e. the target value obtained by dropping the first voltage $V_1$ by the resistance dividing method in the level shifting circuit unit 14, is output at the output terminal 42 of the adder-subtracter circuit unit 32 as the second voltage.

Moreover, when the base bias of the differential transistor 29 is set to a voltage higher than the center voltage Vb, the sign of the current I becomes plus. For example, if the base bias of the differential transistor 29 is set to +(Va/2), the current I becomes $+(Va/2)/R_1$. Consequently, the adjustment voltage, which is the bias voltage generated by the resistance element 34, becomes $-\{+(Va/2)/R_1\}R_2$, and a voltage $V_2=V_5-\{+(Va/2)/R_1\}R_2=V_5-\{(Va/2)/R_1\}R_2$ is output from the output terminal 42 of the adder-subtracter circuit unit 32 as the second voltage. That is, a voltage lower than the target value $V_5$ obtained by dropping the first voltage $V_1$ by the resistance dividing method in the level shifting circuit unit 14 can be output.

Moreover, if the base bias of the differential transistor 29 is set to a voltage lower than the center voltage Vb, the sign of the current I becomes minus. For example, if the base bias of the differential transistor 29 is set to −(Va/2), the current I becomes $-(Va/2)/R_1$. Consequently, adjustment voltage, which is the bias voltage generated by the resistance element 34, becomes $-\{-(Va/2)/R_1\}R_2$, and a voltage $V_2=V_5-\{-(Va/2)/R_1\}R_2=V_5+\{(Va/2)/R_1\}R_2$ is output from the output terminal 42 of the adder-subtracter circuit unit 32, as the second voltage. That is, a voltage higher than the target value $V_5$ obtained by increasing the first voltage $V_1$ by the resistance dividing method in the level shifting circuit unit 14 can be output.

In this way, the magnitude of the bias current I can be varied to be output while the direction of the current I flowing through the resistance element 34 is changed, by varying the base bias of the both side variable power source 26 to larger and smaller values than the center voltage Vb of an arbitrary variable voltage range in the voltage-to-current converting circuit unit 20. That is, the adjustment voltage $IR_2$ can be varied around zero as values on both of the plus side of 0 and the minus side of 0. A voltage obtained by adding or subtracting the adjustment voltage $IR_2$ to or from the voltage $V_5$ output from the level shifting circuit unit 14 can therefore be output from the output terminal 42 of the adder-subtracter circuit unit 32 as the second voltage $V_2$.

Figure 3:
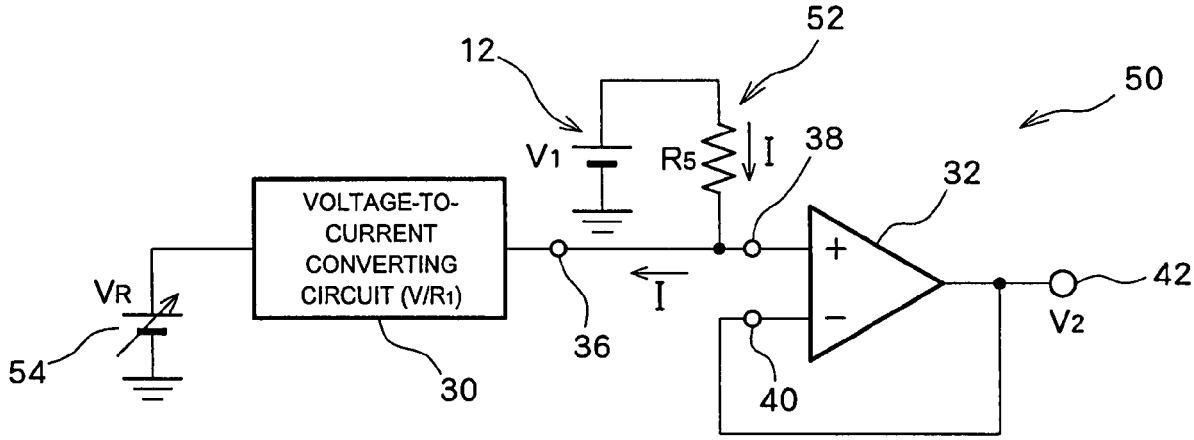
Fig. 3 PRIOR ART
FIG. 3 is a diagram showing the configuration of a related art voltage regulator to be compared.

The operation and the advantages of the voltage regulator 10 having the configuration described above will be described in detail by means of comparison with a related art voltage regulator. FIG. 3 is a diagram showing the configuration of a related art voltage regulator 50. In FIG. 3, the same components as those of FIG. 1 are denoted by the same reference numerals as those of FIG. 1, and their detailed descriptions will be omitted.

Although the voltage regulator 50 is provided with the same V-I converting circuit 30 as the one described with reference to FIG. 1, a variable power source 54 does not vary a voltage on both sides of the center voltage, but is a general variable power source increasing or decreasing a voltage in one direction. The variable voltage range of the variable power source 54 can be the same as the variable range Va of the variable power source 22 of the voltage regulator 10 shown in FIGS. 1 and 2. To put it concretely, the variable power source 54 is the one in which the both side variable power source 26 in FIG. 2 is replaced with a one side variable power source capable of varying a voltage in the range of from 0 V to Va V. Consequently, the direction of the current I appearing at the output terminal 36 of the V-I converting circuit 30 cannot be changed, but the magnitude of the current I can be varied by the voltage adjustment of the variable power source 54. If the voltage of the variable power source 54 is denoted by $V_R$, the current I can be given as $I=V_R/R_2$ using the resistance value $R_2$ described with reference to FIG. 2.

Moreover, although the same adder-subtracter circuit unit as the one described with reference to FIG. 1 can be used as the adder-subtracter circuit unit 32 of the voltage regulator 50, the terminal 40 on the other side thereof is directly connected to the output terminal 42, and no resistance element is provided. A terminal 38 on one side of the adder-subtracter circuit unit 32 is connected to the output terminal 36 of the V-I converting circuit 30 and the first power source 12 having the first voltage $V_1$ through a resistance element 52.

In the related art voltage regulator 50 having the configuration mentioned above, the same voltage as the voltage at the terminal 38 on the one side of the adder-subtracter circuit unit 32 is output from the output terminal 42 as the second voltage $V_2$ as well known. Consequently, if the resistance value of the resistance element 52 is denoted by $R_5$, the output voltage $V_2$ is given as: $V_2=V_1-IR_5=V_1-(V_R/R_2)R_5$. Accordingly, the magnitude of the second voltage $V_2$ can be adjusted by varying the magnitude of the current I by adjusting the voltage $V_R$ of the variable power source 54.

FIGS. 4-7 are views for comparing the operation of the voltage regulator 10 described with reference to FIGS. 1 and 2 with the operation of the related art voltage regulator 50 shown in FIG. 3. In each view, the diagram on the left side illustrates the voltage adjustment operation of the voltage regulator 10, and the diagram on the right side illustrates the voltage adjustment operation of the voltage regulator 50. In each view, in the diagrams on both sides, the abscissa axes indicate the voltages within the ranges of the variable ranges Va of the variable power source 22 and the variable power source 54, and the ordinate axes indicate the second voltage $V_2$ output from the output terminal 42. In each view, the origins of the ordinate axes are taken in common.

Figure 4:
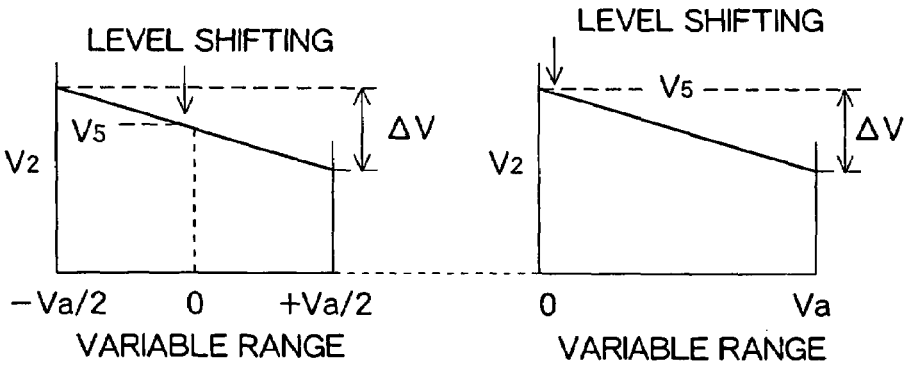
FIG. 4 is a view for comparing the adjustable ranges of second voltages of the voltage regulator of the embodiment according to the present invention and the related art voltage regulator.

The diagram on the left side in FIG. 4 is a diagram showing a typical example of the adjustable range of the second voltage $V_2$ in the variable range of the variable power source 22 in the voltage regulator 10. In this example, the target value $V_5$ of the second voltage is set to the center voltage of the variable range of the variable power source 22, that is, the varied quantity is zero, from the first voltage $V_1$ by the function of the level shifting circuit unit 14. If the adjustable range is compared with that of the diagram on the right side of FIG. 4 showing the typical example of the adjustable range of the second voltage $V_2$ in the variable range of the variable power source 54 in the voltage regulator 50, the following differences can be found. That is, the fact that the target value of level shifting is set to the value at the zero varied quantity in the variable range is the same, but the fact that the target value of the voltage regulator 50 is set not to the center voltage of the variable range but to lowest voltage of the variable range is different, because the variable power source 54 is variable on only one side. Incidentally, the adjustable ranges ΔV of the second voltages $V_2$ by the variable power sources 22 and 54 after the level shifting are the same in the diagrams on both sides in FIG. 4.

Figure 5:
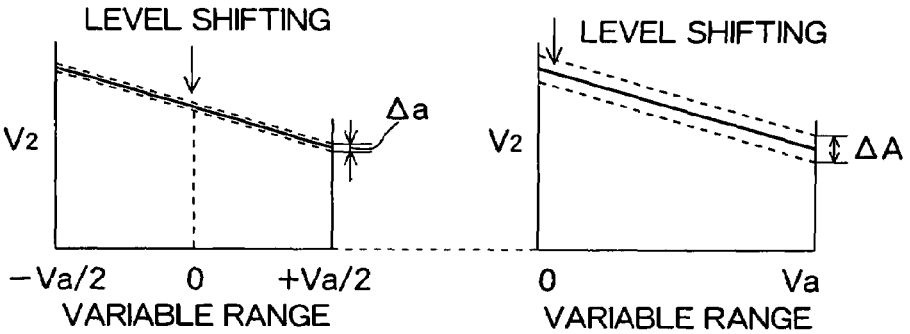
FIG. 5 is a view for comparing the errors of level shifting of the voltage regulator of the embodiment according to the present invention and the related art voltage regulator.

FIG. 5 is a view showing the states of the magnitudes of the errors Δa and ΔA of the target values $V_5$ of level shifting from the first voltages V1 in the voltage regulator 10 and the voltage regulator 50. As shown in the diagram on the left side of FIG. 5, the error Δa in the voltage regulator 10 can be suppressed to be considerably small by raising the accuracy of the resistance ratio because the target value $V_5$ of the level shifting from the first voltage $V_1$ is realized by the resistance dividing method as described with regard to the configuration of the level shifting circuit unit 14. On the other hand, the level shifting of the related art voltage regulator 50 is determined by the resistance value $R_5$ and the current I output from the V-I converting circuit 30. Because the current I output from the V-I converting circuit 30 is a result of the operation of the circuit composed of many electronic parts, such as the pair of differential transistors 27 and 29, as described related to FIG. 2, there is a possibility that the variations in the characteristics of each electric part are accumulated to alter the current I. Consequently, the magnitude of the error AA of the target value $V_5$ of the level shifting from the first voltage $V_1$ in the related art becomes a larger value as shown in the diagram on the right side of FIG. 5 in comparison with the error Δa capable of being suppressed by the resistance ratio as shown in the diagram on the left side of FIG. 5.

Figure 6:
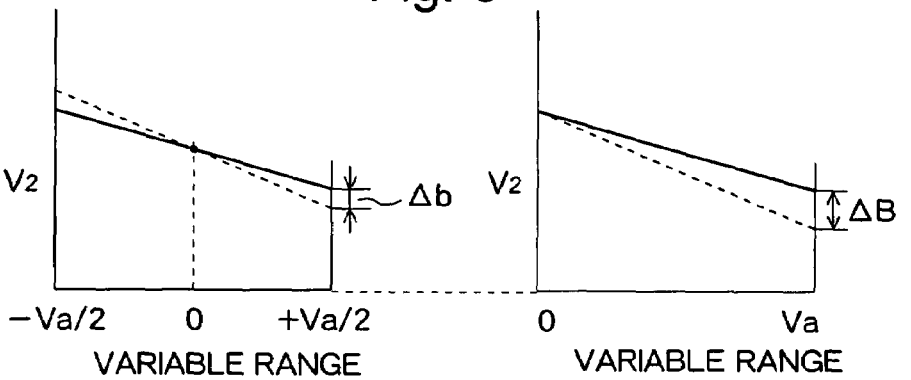
FIG. 6 is a view for comparing the errors of the adjustment voltages of variable power sources of the voltage regulator of the embodiment according to the present invention and the related art voltage regulator.

FIG. 6 is a view showing the states of the errors Δb and ΔB of the magnitudes of the adjustment voltages of the variable power sources 22 and 54 in the voltage regulator 10 and the voltage regulator 50. The errors Δb and ΔB increase as the adjustment voltages of the variable power sources 22 and 54 become larger. In the voltage regulator 10, because the variable power source 22 is the both side variable power source capable of being adjusted to both sides of the center voltage, the adjustment voltage is zero at the center voltage in the variable range, and the error Δb becomes zero. Consequently, as shown in the diagram on the left side of FIG. 6, the error Δb of the magnitude of the adjustment voltage of the variable power source 22 takes the maximum value at the adjustment voltages of −Va/2 and +Va/2 at both ends of the variable range. On the other hand, in the case of the related art voltage regulator 50, because the variable power source 54 is the one side variable power source, the adjustment voltage is zero at the lowest voltage in the variable range as shown in the diagram on the right side of FIG. 6, and the error ΔB consequently increases as the adjustment voltage becomes larger to take the maximum value at the maximum voltage Va in the variable range. If it is assumed that the increasing rate of the error owing to the variable power source to the adjustment voltage does not differ between the voltage regulator 10 of FIGS. 1 and 2 and the voltage regulator 50 of FIG. 3, the maximum quantity of the error Δb of the adjustment voltage in the diagram on the left side of FIG. 6 is Va/2. On the other hand, the maximum quantity of the error ΔB of the adjustment voltage in the diagram on the right side of FIG. 6 is Va. As described above, the maximum value of the error ΔB is twice as large as the maximum value of the error Δb.

Figure 7:
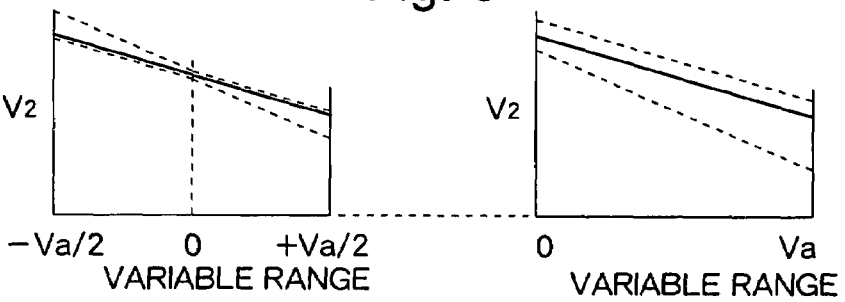
FIG. 7 is a view for comparing the overall errors of the second voltages of the voltage regulator of the embodiment according to the present invention and the related art voltage regulator.

FIG. 7 is a view showing the states of the second voltages $V_2$ in terms of total errors of level shifting and the errors of the adjustment voltages of the variable power sources 22 and 54 in the voltage regulator 10 and the voltage regulator 50. As described above, the maximum value of the error Δa is considerably smaller than the maximum value of the error ΔA, and the maximum value of the error Δb is ½ of the maximum value of the error ΔB. Consequently, the magnitude of the error of the second voltage $V_2$ of the voltage regulator 10 shown in the diagram on the left side in FIG. 7 can be smaller than the error of the second voltage of the related art voltage regulator 50 shown in the diagram on the right side of FIG. 7. Hence, the voltage regulator 10 described with reference to FIGS. 1 and 2 can set a desired potential difference more correctly at the time of generating the second voltage $V_2$ having the desired potential difference from the first voltage $V_1$.

Figure 8:
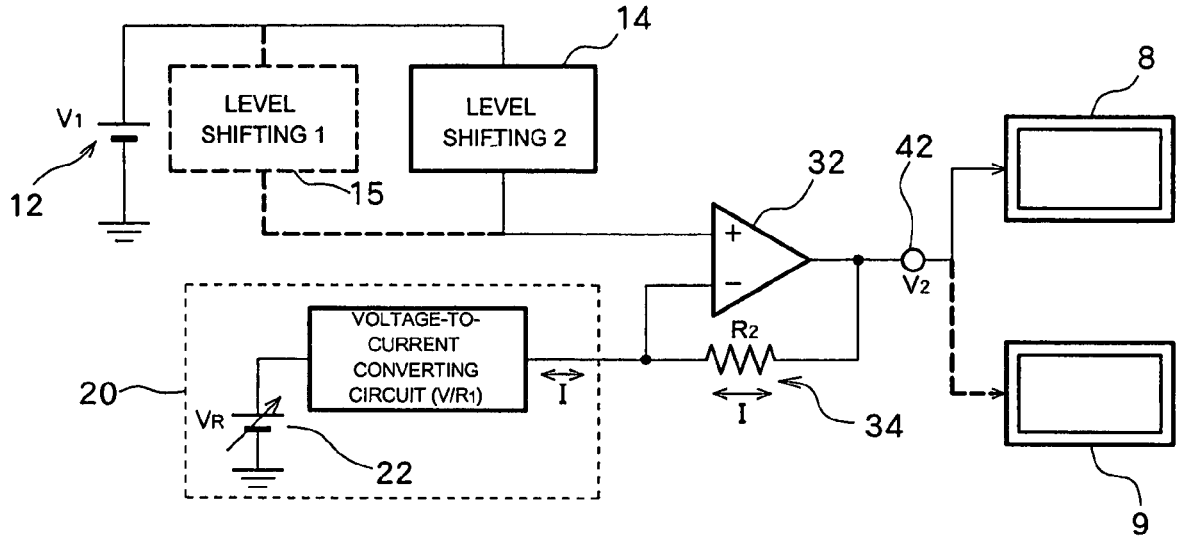
FIG. 8 is a diagram showing an example of applying the voltage regulator of the embodiment according to the present invention to liquid crystal display apparatus having different specifications.

FIG. 8 is a diagram showing an example of the application of the voltage regulator 10 having the configuration described above to liquid crystal display apparatus 8 and 9. A liquid crystal display apparatus generally has different potential difference between the first voltage $V_1$ used for the DC bias of a video signal and a second voltage $V_2$ used for the DC bias of a common electrode signal, according to the specification of the display apparatus. Moreover, some liquid crystal display apparatus of similar types may have slightly different potential differences between the first voltages $V_1$ and the second voltages $V_2$ according to customer requirements. FIG. 8 shows the configuration of the level shifting circuit units 14 and 15 and the voltage-to-current converting circuit unit 20 that are applied to the two liquid crystal display apparatus 8 and 9 having different potential differences between the first voltages $V_1$ and the second voltages $V_2$.

If the potential differences between the first voltages $V_1$ and the second voltages $V_2$ are slightly different between the liquid crystal display apparatus 8 and 9 and the difference can be adjusted in the variable ranges of the variable power sources 22, then the same level shifting circuit unit 14 and the same voltage-to-current converting circuit unit 20*a* can be used in both of the liquid crystal display apparatus 8 and 9. That is, two voltage regulators having the same specification contents, each composed of the level shifting circuit unit 14 and the voltage-to-current converting circuit unit 20, can be manufactured for the liquid crystal display apparatus 8 and 9. Then, in the liquid crystal display apparatus 8, the variable power source 22 is adjusted so that the potential difference between the first voltage $V_1$ and the second voltage $V_2$ may be a desired potential difference. Moreover, in the liquid crystal display apparatus 9, the variable power source 22 is adjusted so that the potential difference between the first voltage $V_1$ and the second voltage $V_2$ may be a desired potential difference. That is, simply by differently adjusting the variable power sources 22, the liquid crystal display apparatus 8 and 9 can be manufactured in accordance with respective specifications.

If the potential differences between the first voltages $V_1$ and the second voltage $V_2$ are considerably different between the liquid crystal display apparatus 8 and 9 and the difference cannot be adjusted within the variable ranges of the variable power sources 22, then the liquid crystal display apparatus 8 and 9 use the level shifting circuit units 14 and 15 that are fitted to the respective specifications. The voltage-to-current converting circuit units 20 may be the same ones. That is, the liquid crystal display apparatus 8 uses the level shifting circuit unit 14 and the voltage-to-current converting circuit unit 20, and the variable power source 22 is adjusted so that the potential difference between the first voltage $V_1$ and the second voltage $V_2$ may be the desired potential difference. Moreover, the liquid crystal display apparatus 9 uses the level shifting circuit unit 15 and the voltage-to-current converting circuit unit 20, and the variable power source 22 is adjusted so that the potential difference between the first voltage $V_1$ and the second voltage $V_2$ may be the desired potential difference. By varying the specifications of the level shifting circuit units 14 and 15, i.e. the resistance ratios in the resistance dividing method, in such a way, the liquid crystal display apparatus 8 and 9 can be manufactured in accordance with the respective specifications.

Figure 10:
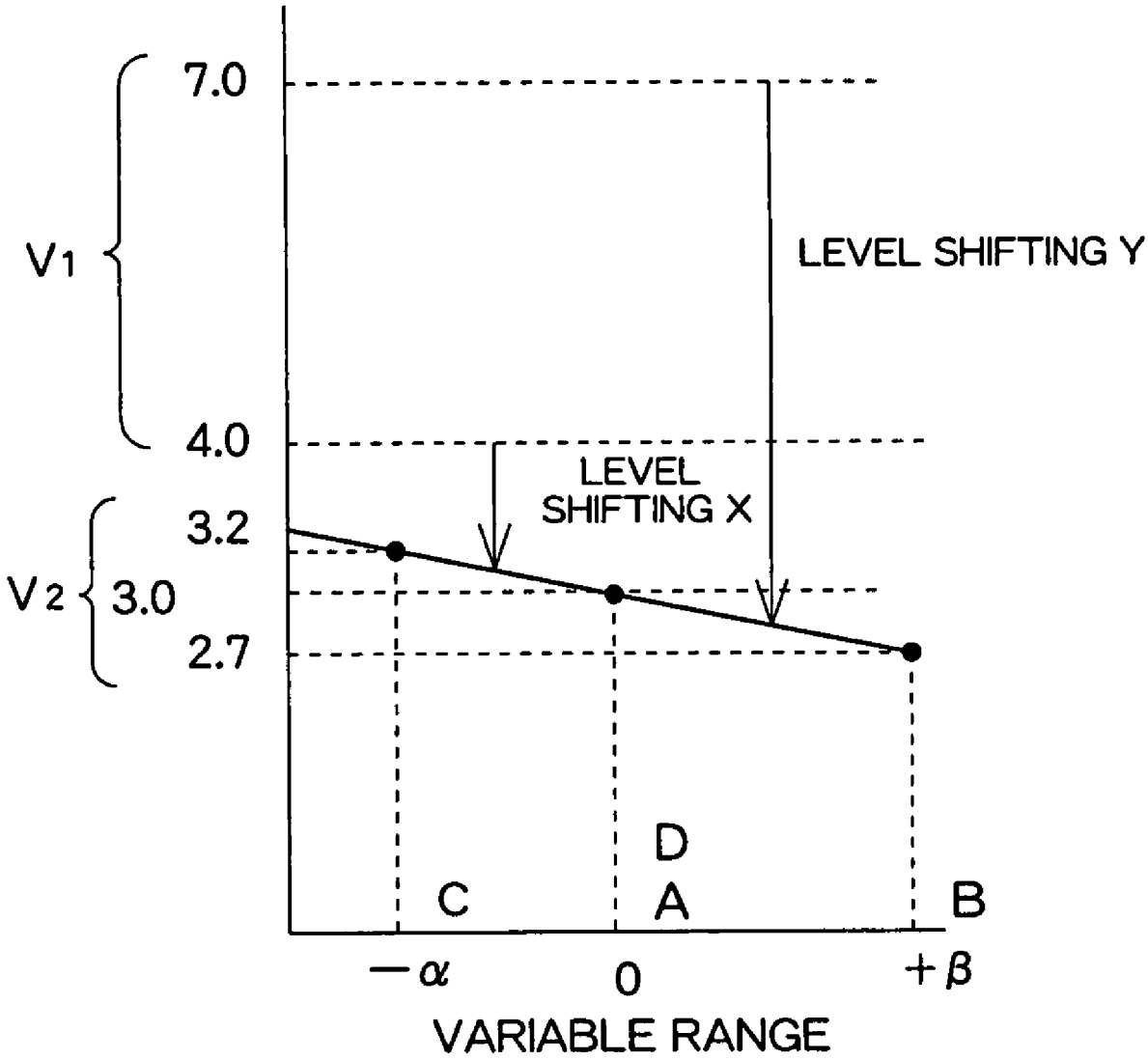
FIG. 10 is a diagram for illustrating the state of generating the various second voltages from a first voltage correspondingly to FIG. 9.

FIGS. 9 and 10 are diagrams for illustrating the configuration examples of voltage regulators dealing with various demands of customers. FIG. 9 shows two models of X and Y as the models of the liquid crystal display apparatus, and three kinds of demands A, B, and C of the customers for the model X as examples. FIG. 9 collects up the contents of the respective first voltages $V_1$ and the respective second voltages $V_2$, and the contents of the voltage-to-current converting circuit units and the level shifting circuit units for realizing the demands. FIG. 10 is a diagram showing the states of generating the second voltages $V_2$ from the first voltages $V_1$ according to the demands. FIG. 10 plots voltages in the variable ranges of the variable power sources on the abscissa axis, and plots the first voltages $V_1$ and the second voltage $V_2$ on the ordinate axis.

In FIG. 9, the model X has the first voltage $V_1$ of 4.0 V and the second voltage $V_2$ of 3.0 V as a standard voltage setting, and supply is performed to the customer A in accordance with the specification. The model X for the customer A can perform the setting of the variable power source of the voltage-to-current converting circuit unit to the center voltage by setting the level shifting circuit unit so that the first voltage is 4.0 V, the resistance dividing ratio is 3/4, and the target value of the second voltage is 3.0 V. The state is indicated by a mark A in FIG. 10. Incidentally, if an output voltage of the adder-subtracter circuit unit is shifted from 3.0 V owing to the dispersion of the level shifting circuit unit and the like at a production stage, the output voltage can be correctly adjusted to the desired 3.0 V by adjusting the variable power source.

In FIG. 9, the demand of the customer B is to vary the first and the second voltages to 4.0 V and 2.7 V, respectively, on the basic specification of the model X. In this case, the resistance dividing ratio of the level shifting circuit remains 3/4, and the variable power source of the voltage-to-current converting circuit unit is adjusted so that the output voltage of the adder-subtracter circuit unit may become 2.7 V. This state is indicated by a mark B in FIG. 10. Similarly, the demand of the customer C in FIG. 9 is to vary the first and the second voltages to 4.0 V and 3.2 V, respectively, on the basic specification of the model X. In this case, the resistance dividing ratio of the level shifting circuit remains 3/4, and the variable power source of the voltage-to-current converting circuit unit is adjusted so that the output voltage of the adder-subtracter circuit unit may become 3.2 V. This state is indicated by a mark C in FIG. 10. If the range of the demands of customers and the range of the dispersion of manufacturing can be adjusted within the variable range of the variable power source of the voltage-to-current converting circuit unit like the above cases, a desired potential difference between the first and the second voltages can be obtained by adjusting the variable power source, leaving the level shifting circuit unit in the state of the standard specification.

In FIG. 9, the customer D has a demand of varying the first and the second voltages to be 7.0 V and 3.0 V, respectively. If the potential difference cannot be achieved in the variable range of the variable power source of the voltage-to-current converting circuit unit, then the resistance ratio of the level shifting unit is varied. That is, the dividing resistance ratio is changed to 3/7, and the setting of the variable power source of the voltage-to-current converting circuit unit is changed to the center voltage. This state is indicated by a mark D in FIG. 10. If the potential difference between the first and the second voltages is large to exceed the adjustable range by the variable range of the variable power source of the voltage-to-current converting circuit unit like the case mentioned above, then such a situation can be dealt with by changing the configuration of the level shifting unit.

The adjustment of the rough range of the potential difference can be performed by changing the dividing resistance ratio of the level shifting circuit unit, and fine adjustment of the potential difference can be performed by changing the setting of the variable power source of the voltage-to-current converting circuit unit as described above. Consequently, combination of these adjustments enables highly accurate adjustment setting in a wide range to a desired potential difference by the two steps of rough adjustment and fine adjustment.

What is claimed is:

1. A voltage regulator generating a second voltage having a desired potential difference from a first voltage, the voltage regulator comprising:

a level shifting circuit unit shifting a voltage level of the first voltage to a target voltage level to output the shifted first voltage;

a voltage-to-current converting circuit unit varying a magnitude of an output current to output the current while changing a direction of the current by varying a voltage to larger and smaller values with respect to a center voltage of an arbitrarily variable voltage range; and an adder-subtracter circuit unit having a first terminal on one side, the first terminal being connected to an output terminal of the level shifting circuit unit, and a second terminal on the other side, the second terminal being connected to a resistance element disposed between the second terminal and an output terminal of the adder-subtracter circuit, the resistance element allowing an output current of the voltage-to-current converting circuit unit to flow therethrough as a bias current, wherein a bias voltage generated by the bias current and the resistance element is used as an adjustment voltage and a voltage generated by addition and subtraction of the adjustment voltage to and from a voltage output from the level shifting circuit unit is output from the adder-subtracter circuit unit as the second voltage, wherein the voltage-to-current converting circuit unit changes a direction of the current into an opposite direction when the voltage-to-current converting circuit unit varies the voltage on a side of the voltage lower than the center voltage to a direction when the voltage-to-current converting circuit unit varies the voltage on a side of the voltage higher than the center voltage.

2. The voltage regulator according to claim 1, wherein the level shifting circuit unit shifts the voltage level using a resistance dividing method.

3. The voltage regulator according to claim 1, wherein the first voltage is a center voltage of a video signal in a liquid crystal display driving circuit;

the second voltage is a common electrode center voltage;

the center voltage of the video signal is supplied to the level shifting circuit unit; and the voltage-to-current converting circuit unit varies the voltage to output a desired common electrode center voltage from the adder-subtracter circuit unit.

* * * * *